United States Patent [19]

Star

[11] 4,043,558

[45] Aug. 23, 1977

[54] MAGNETIC MAZE GAME

[76] Inventor: Scott Clifford Star, 60-33 61st St., Maspeth, N.Y. 11378

[21] Appl. No.: 660,454

[22] Filed: Feb. 23, 1976

[51] Int. Cl.[2] ..... A63F 3/00; A63F 9/00

[52] U.S. Cl. ..... 273/110; 273/1 M

[58] Field of Search ..... 273/1 M, 108–116, 273/118 A, 119 A, 120 A, 121 A, 122 A, 123 A, 124 A, 125 A, 126 A, 134 AE; 35/19 A; 46/238, 239, 240

[56] References Cited

U.S. PATENT DOCUMENTS

| | | | |
|---|---|---|---|
| 588,988 | 8/1897 | Harrington | 273/1 M X |
| 1,059,928 | 4/1913 | Cook | 273/1 M X |
| 2,511,774 | 6/1950 | Goldsmith | 273/1 M X |
| 2,665,912 | 1/1954 | Juran | 273/118 A |
| 3,522,945 | 8/1970 | Wagner | 273/123 A |
| 3,764,144 | 10/1973 | Arthur | 273/1 M X |
| 3,764,145 | 10/1973 | Schrafft | 273/131 AD |
| 3,834,707 | 9/1974 | Birkett | 273/126 A |
| 3,964,746 | 6/1976 | MacMurdo | 273/108 |
| 3,967,824 | 7/1976 | Lund | 273/110 |

*Primary Examiner*—Richard J. Apley
*Attorney, Agent, or Firm*—Lackenbach, Lilling & Siegel

[57] ABSTRACT

A magnetic maze game having a playing surface is provided with a plurality of magnets fixedly disposed about said surface so as to define a playing course or field. A player tries to move a single magnetic playing piece through the entire course or field without the playing piece being attracted to one of the fixed magnets. This can be done by the skillful manipulation of the surface by a player, such that tilting and/or turning of the surface enables the playing piece to move or slide about the course or field in the precise path or circuit desired in order to avoid attraction to any fixed magnet.

11 Claims, 4 Drawing Figures

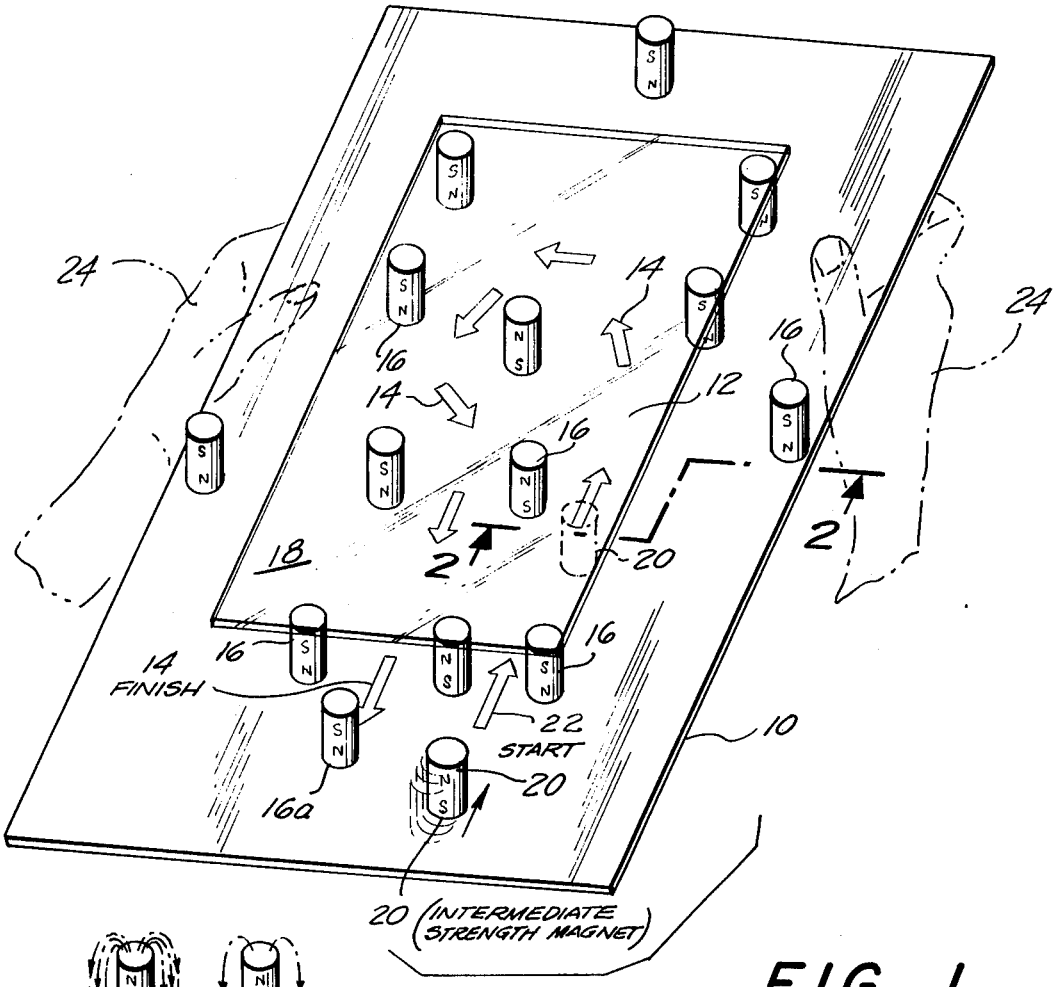
FIG. 1
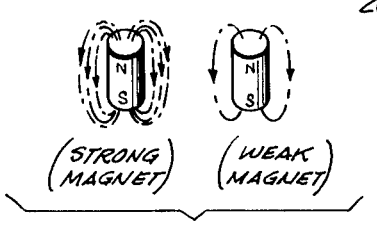
FIG. 3
FIG. 2
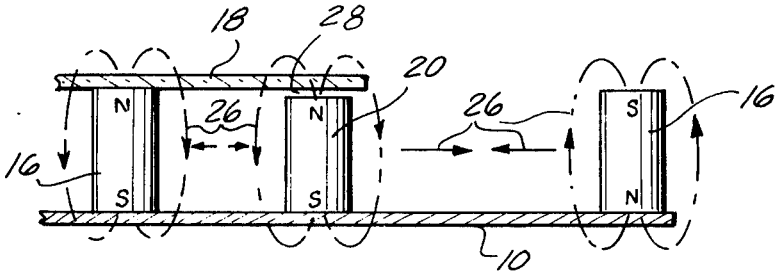
FIG. 4
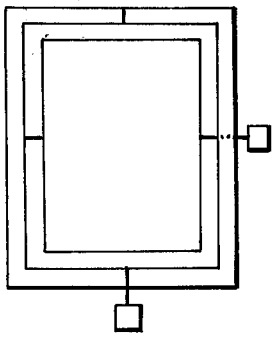

MAGNETIC MAZE GAME

BACKGROUND OF THE INVENTION

The effects and uses of magnetism have been known for quite some time. Over the years many inventors have employed magnetism to create a variety of games requiring various degrees of skill. Some of these types of games are educational, such as the game disclosed in U.S. Pat. No. 3,764,145 or in U.S. Pat. No. 1,225,787. Some games have been made strictly to amuse or entertain adults and/or children alike.

Another U.S. Pat. No., to Juran, U.S. Pat. No. 2,665,912, discloses a magnetic shuffleboard-like game. The playing surface of this game is inclined. Various regions are marked on the playing surface and each region is worth a predetermined amount or number of points, the region being farthest down the playing surface having the highest point value. A plurality of magnets of varying strengths are arranged in each region. To play the game, a player starts a metallic ball rolling down the incline. The magnets will cause the ball to travel a sort of zig-zag course. It is possible for the ball to either be attracted to or captured by one of the magnets or to pass through all the regions. In point scoring, each player is awarded the point value of the region each played ball ends up in.

Maze type games have been fascinating countless people since ancient times. Initially these games were rather simple and usually required the player to move a ball through a path provided with traps, such as holes positioned so as to interfere with and prevent further movement of the ball. In time, such games or mazes became more intricate and more things were added to the mazes to make them increasingly more difficult to play so as to increase their entertainment and/or educational value.

Examples of early magnetic games are Cook, U.S. Pat. No. 1,059,928 and Dingledine, U.S. Pat. No. 1,888,980. These inventors perfected magnetic games in the early part of this century.

In Kernodle, U.S. Pat. No. 3,116,929, magnetism was used to form a toy of a maze game type having a labyrinth designed on the game's playing surface. A magnet is then used to direct a magnetic object through the desired course. U.S. Pat. No. 3,712,617 to Oshschlager involves a more intricate magnetic maze game, particularly with regard to the system for moving a magnet back and forth.

BRIEF DESCRIPTION OF THE INVENTION

In the invention, numerous magnets are employed to outline a maze. These magnets are secured to a playing surface which can be manually moved or manipulated. A playing magnet is then placed at the starting point on the playing surface of the maze. The player then picks up the playing surface and by tilting, turning and/or the simultaneous movement about two axes of the surface, a skillfuly player can cause the magnet to slide on the playing surface in any predetermined path. In the game of the present invention, the player tries to slide the magnet through the maze or course without it being attracted to one of the magnets forming the maze outline. If any player fails to do so, he must repeat or start over from the starting point again.

An advantage inherent in this game is that the fixed magnets are of various strengths and polarity and they are used to cause or move the playing magnet piece out of the desired maze course instead of maintaining it in the desired course.

It is therefore a principal of the invention to create a relatively simple game and one that is inexpensive to fabricate.

Another object of the invention is to create a game which will enable a more skillful player to obtain better results or to aid in the development of one's manual dexterity in playing such maze games of the present type.

The invention accordingly consists in the features of construction, combination of elements, and arrangement of parts which will be exemplified in the construction hereinafter described, and, of which the scope will be indicated by the appended claims.

BRIEF DESCRIPTION OF THE DRAWINGS

FIG. 1 is a perspective view from above of the magnetic maze game of the present invention;

FIG. 2 is a cross-sectional view of the invention, taken along the lines 2—2 of FIG. 1; and FIG. 3 shows the magnetic field on two magnets, that may be used as playing pieces, of varying strengths.

FIG. 4 is a schematic view of a gimbal mounted playing surface.

DETAILED DESCRIPTION OF THE INVENTION

The playing surface 10 may be made from any suitable flat, smooth piece of material, such as a rectangular piece, and it may be of plastic, if desired. Outlined on the playing surface 10 is a course 12 illustrated by the directional arrows 14 and 22. Any course that fits on the playing surface may be used.

Several magnets 16 of varying strengths are set up and fixedly disposed along the course, in order to serve as outer boundaries for the course. These magnets are attached to the surface in any suitable manner, as some of the magnets will have their North pole facing up, others will have their South pole facing up. Here, adhesives may be used.

A generally clear plastic sheet 18 is placed over some of the magnets 16 in order to preclude the playing magnet from flipping over to align itself with the opposite polarity of a fixed magnet which may attract it. All of the fixed magnets may be covered by the sheet 18, so long as one can reach beneath it to remove the playing magnet should it be attracted to any fixed magnet. The sheet 18 is preferably clear, translucent or transparent so one can readily see the course or maze and also see where the playing magnet is stuck when same is attracted to a fixed magnet. With all fixed magnets aligned alike such that their polarity orientation is the same, for example, North poles attached to the playing surface 10 and their South poles extending upwardly, there would be no need for a sheet 18 as a playing magnet 20 likewise oriented and placed on the playing surface 10 would not flip over. Of course, with such a maze game construction, one would have all fixed magnets either attracting or repulsing the playing magnet. However, such game construction would provide even further entertainment and require considerable skill. With the variation where all of the fixed magnets repulse the playing magnet, the playing surface would be provided with a number of apertures spaced throughout the maze, and in such case, the game would be over or lost when the playing magnet falls through an aperture when repulsed by a fixed magnet.

The game is supplied with a plurality of magnetic playing pieces 20 of varying strengths so that a more skillful player can use increasingly stronger playing magnets to better his skill. Likewise, a non-skillful player may start with the weakest magnet and try to improve his skill by playing with increasingly stronger magnets.

To play the game, a playing piece 20 is placed at the beginning 22 of the course 12. The player then picks up the surface 10 with his hands 24. By turning and tilting the surface he can slide the playing piece 20 across the surface. Each player tries in turn to move his piece through the course without being caught or captured by one of the magnets 16.

As some of the magnets 16 have their North pole up and others have their South pole up, some of these magnets attract the playing pieces 20 and others repel the playing pieces 20, as shown by the lines of magnetic force 26 in FIG. 2. The game is ended when a player successfully moves his playing piece through the entire maze and the movable playing piece upon leaving the maze is attracted to the last fixed magnet 16a.

It should be appreciated that the playing surface may be mounted in a conventional two-direction gimballed box. A system of handles or other controlling knobs may then be used to automatically turn and tilt the playing surface, as shown schematically in FIG. 3. In addition, by setting the spacing between fixed magnets closer or further apart or by using stronger or weaker fixed magnets, the game can, when manufactured, be made for an expert, intermediate player, or for a beginner, as desired.

The game of the invention is a very entertaining and fascinating new way of testing the manual dexterity of an individual player.

The playing surface 10 should be a generally clean surface so as to minimize the frictional resistance to the movement of the playing magnet 20. If desired, the playing surface 10 may be suitably coated with a material which substantially reduces the coefficient of friction between the playing magnet 20 and the playing surface 10. Obviously, there is no frictional resistance along the top surface of the playing magnet 20 and the cover sheet 18 as the height of the playing magnet 20 is less than the spacing between the parallel sheets 10 and 18. A gap is shown, for example, in FIG. 2.

While the invention has been described, disclosed, illustrated and shown in terms of an embodiment or modification which it has assumed in practice, the scope of the invention should not be deemed to be limited by the precise embodiment or modification herein described, disclosed, illustrated or shown, such other embodiments or modifications as may be suggested to those having the benefit of the teaching herein being intended to be reserved especially as they fall within the scope and breadth of the claims here appended.

I claim:

1. A magnetic game comprising:

a playing surface;

a plurality of magnets of varying strengths immovably positioned on said playing surface to define a predetermined maze or course; and a magnetic playing piece movably placed on said surface, so that by turning and tilting the said playing surface the magnetic playing piece may be moved through the course without said playing piece being attracted to any of said immovable magnets.

2. The game according to claim 1, wherein some of the plurality of magnets are positioned with their North pole up and the remaining magnets are positioned with their South pole up.

3. The game according to claim 1, further comprising a transparent sheet fixedly placed in a parallel position over said playing surface and being attached to and covering at least some of said plurality of magnets.

4. The game according to claim 1, further comprising a transparent sheet disposed in a parallel position with respect to said playing surface and being secured thereto, and said sheet extending over at least some of said plurality of magnets.

5. The game according to claim 1, wherein said pluraity of magnets comprise bar magnets having parallel end surfaces.

6. The game according to claim 5, wherein said bar magnets are cylindrical in shape.

7. The game according to claim 1, wherein the polarity orientation of all of said plurality of magnets is aligned in one direction.

8. The game according to claim 7, wherein said polarity orientation is such that said plurality of magnets all attract said magnetic playing piece.

9. The game according to claim 1, wherein said playing surface is movable by means of being mounted in a player's hands during the play of said game.

10. The game according to claim 1, wherein said playing surface is gimbal mounted so as to be pivotable in orthogonal directions.

11. A magnetic game comprising:

a playing surface;

a plurality of magnets immovably positioned on said playing surface to define a predetermined maze or course; and a plurality of magnetic playing pieces, each of different strengths, only one of which is used at a time; whereby depending upon the skill of a player a magnetic playing piece movably placed on said surface may be moved through the course or maze without said playing piece being attracted to any of said immovable magnets.

* * * * *